US010992021B2

(12) United States Patent
Elsherbini et al.

(10) Patent No.: US 10,992,021 B2
(45) Date of Patent: Apr. 27, 2021

(54) CROSS TALK AND INTERFERENCE REDUCTION FOR HIGH FREQUENCY WIRELESS INTERCONNECTS

(71) Applicant: Intel Corporation, Santa Clara, CA (US)

(72) Inventors: Adel A. Elsherbini, Chandler, AZ (US); Telesphor Kamgaing, Chandler, AZ (US); Sasha N. Oster, Chandler, AZ (US); Georgios C. Dogiamis, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 65 days.

(21) Appl. No.: 15/745,681

(22) PCT Filed: Sep. 24, 2015

(86) PCT No.: PCT/US2015/052063

§ 371 (c)(1),
(2) Date: Jan. 17, 2018

(87) PCT Pub. No.: WO2017/052566

PCT Pub. Date: Mar. 30, 2017

(65) Prior Publication Data

US 2018/0212322 A1 Jul. 26, 2018

(51) Int. Cl.
*H01Q 1/22* (2006.01)
*H01Q 1/52* (2006.01)

(52) U.S. Cl.
CPC ..... *H01Q 1/2283* (2013.01); *H01Q 1/521* (2013.01); *H01Q 1/525* (2013.01)

(58) Field of Classification Search
CPC ..... H01Q 1/2283; H01Q 1/521; H01Q 1/523; H01Q 1/525
See application file for complete search history.

(56) References Cited

U.S. PATENT DOCUMENTS

2011/0156946 A1 6/2011 Margomenos
2012/0295539 A1 11/2012 Mccormack et al.
(Continued)

FOREIGN PATENT DOCUMENTS

CN 1579054 2/2005
CN 1856944 11/2006
(Continued)

OTHER PUBLICATIONS

International Preliminary Search Report for International Patent Application No. PCT/US2015/052063, dated Apr. 5, 2018, 8 pages.
(Continued)

*Primary Examiner* — Robert Karacsony
(74) *Attorney, Agent, or Firm* — Schwabe, Williamson & Wyatt, P.C.

(57) ABSTRACT

Embodiments of the invention may include packaged device that may be used for reducing cross-talk between neighboring antennas. In an embodiment the packaged device may comprise a first package substrate that is mounted to a printed circuit board (PCB). A plurality of first antennas may also be formed on the first package. Embodiments may also include a second package substrate that is mounted to the PCB, and the second package substrate may include a second plurality of antennas. According to an embodiment, the cross-talk between the first and second plurality of antennas is reduced by forming a guiding structure between the first and second packages. In an embodiment the guiding structure comprises a plurality of fins that define a plurality of pathways between the first antennas and the second antennas.

23 Claims, 8 Drawing Sheets

(56) References Cited

U.S. PATENT DOCUMENTS

| | | | | |
|---|---|---|---|---|
| 2013/0023210 | A1* | 1/2013 | Rofougaran | H01L 23/66 455/41.1 |
| 2013/0314280 | A1* | 11/2013 | Maltsev | H01Q 3/34 342/368 |
| 2015/0070228 | A1* | 3/2015 | Gu | H01Q 1/2283 343/727 |

FOREIGN PATENT DOCUMENTS

| | | |
|---|---|---|
| EP | 2339693 | 6/2011 |
| KR | 10-2008-0078692 | 8/2008 |

OTHER PUBLICATIONS

Office Action from Chinese Patent Application No. 201580082629.8, dated Jun. 3, 2020, 8 pages.

International Search Report and Written Opinion for International Patent Application No. PCT/US2015/052063 dated Jun. 23, 2016, 13 pgs.

Notice of Allowance from Chinese Patent Application No. 201580082629.8, dated Nov. 4, 2020, 4 pages.

* cited by examiner

CROSS TALK AND INTERFERENCE REDUCTION FOR HIGH FREQUENCY WIRELESS INTERCONNECTS

CROSS-REFERENCE TO RELATED APPLICATION

This patent application is a U.S. National Phase Application under 35 U.S.C. § 371 of International Application No. PCT/US2015/052063, filed Sep. 24, 2015, entitled "CROSS TALK AND INTERFERENCE REDUCTION FOR HIGH FREQUENCY WIRELESS INTERCONNECTS," which designates the United States of America, the entire disclosure of which is hereby incorporated by reference in its entirety and for all purposes.

FIELD OF THE INVENTION

Embodiments of the present invention relate generally to the manufacture of semiconductor devices. In particular, embodiments of the present invention relate to wireless interconnects in semiconductor packages and methods for manufacturing such devices.

BACKGROUND OF THE INVENTION

In many computer systems multiple integrated circuit chips communicate with each other to perform the programmed operations. The different chips may include central processing units, high speed memories, mass storage devices, chipsets, video processors, and input/output interfaces. Some computers may have more than one of each of these kinds of chips. The chips are traditionally mounted to a motherboard or system board either directly or through a socket or a daughter card.

The chips traditionally communicate using copper interconnects or links that travel through the chip's package vias, through the socket, through the platform motherboard and then back through the socket and package of the next chip. However, with increasing data rates, the Input/Output (I/O) density increases and requires additional complexity in the design of the socket that connects the package to the motherboard.

In another variation, a flexible connector cable is connected directly between two different packages to bypass the socket and the platform motherboard. This provides a more direct path with fewer interfaces through different connections. However, the flexible connector cable is bulky, and can interfere with mechanical and thermal assembly requirements.

Thus, improvements are needed in interconnect technologies.

DETAILED DESCRIPTION OF THE INVENTION

Described herein are systems that include a device package with wireless interconnects that have reduced cross-talk and interference between the wireless interconnects. In the following description, various aspects of the illustrative implementations will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative implementations. However, it will be apparent to one skilled in the art that the present invention may be practiced without the specific details. In other instances, well-known features are omitted or simplified in order not to obscure the illustrative implementations.

Various operations will be described as multiple discrete operations, in turn, in a manner that is most helpful in understanding the present invention, however, the order of description should not be construed to imply that these operations are necessarily order dependent. In particular, these operations need not be performed in the order of presentation.

As described herein, a flexible radio frequency interconnect provides point-to-point or single point to multiple point data communication. It may be used as the only data interface or as a supplement to cable or copper interconnect technologies. Some connections may be moved to a radio interface to lessen the complexity of the socket. This may also improve signal fidelity by avoiding losses in an electrical connection.

A wireless interconnect may be built on the package of a chip to provide over the air transmission between two different microelectronic chips at very high data rates. The wireless interconnect may be driven at millimeter wave (mm-wave) or sub-Terahertz (sub-THz) frequencies, where the antennas may be made extremely small to fit on the package of a small microelectronic chip. In addition, the fractional bandwidth may be made very large to allow very high data rates with simple and low power modulation schemes.

Figure 1A:
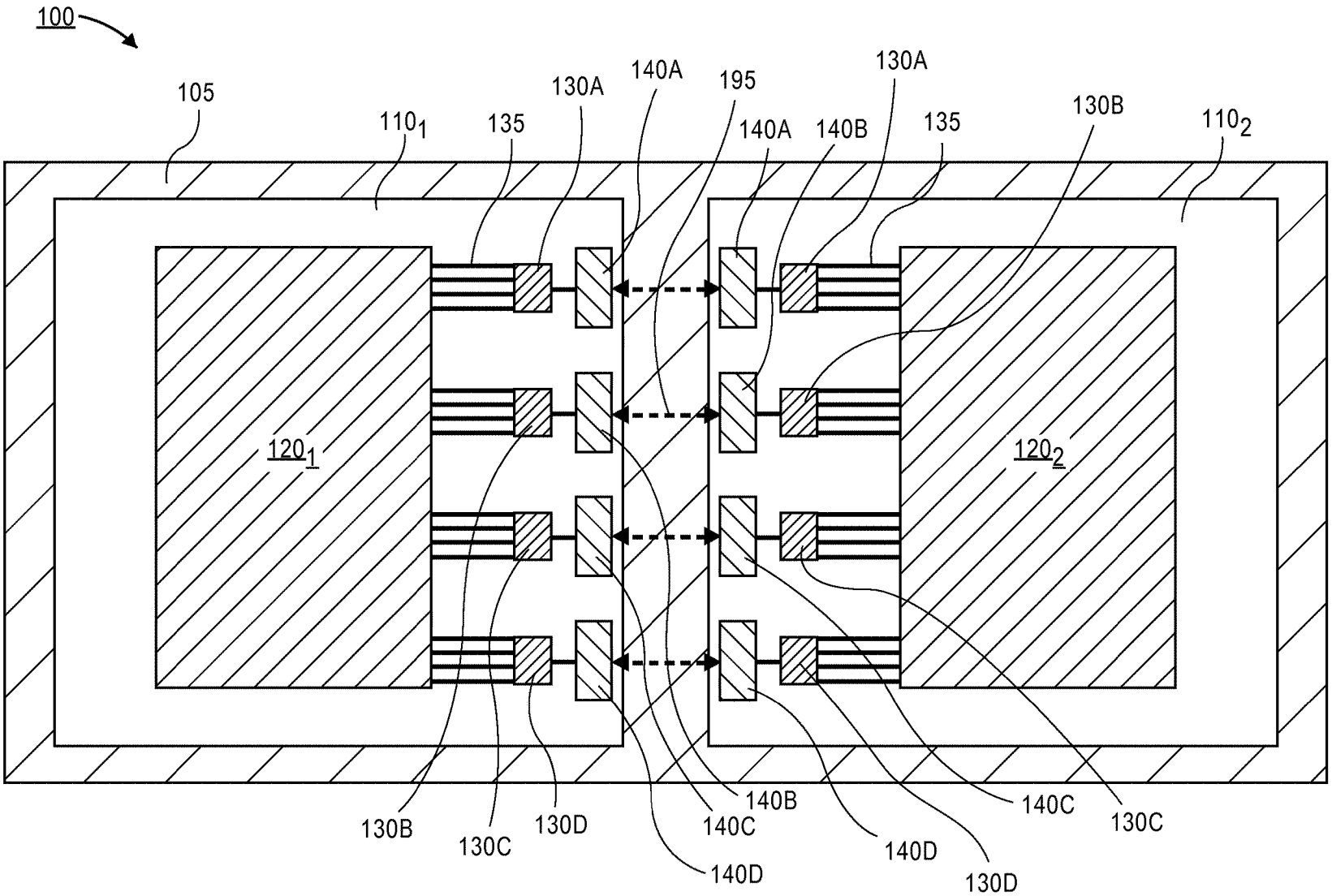
FIG. 1A is a plan view illustration of a server package that includes a first chip package and a second chip package that may communicate with each other with one or more wireless interconnects, according to an embodiment of the invention.

Referring now to FIG. 1A, an overhead plan view of a server platform 100 that utilizes radio frequency interconnects is illustrated. A first $\mathbf{110}_1$ and second $\mathbf{110}_2$ package substrate are mounted to a motherboard 105, such as a printed circuit board (PCB), system or logic board or daughter card using a solder ball array or any other desired system. A first processing unit $\mathbf{120}_1$ and a second processing unit $\mathbf{120}_2$ are each mounted to a respective package substrates $\mathbf{110}_1$, $\mathbf{110}_2$ using a ball grid array (BGA), land grid array (LGA), or other connection system including pads, wire leads, or other connectors. In an embodiment, the first and second package substrates $\mathbf{110}_1$, $\mathbf{110}_2$ may be electrically connected to external components, power, and any other desired devices through traces (not shown) on the PCB 105.

The first and second processing units $\mathbf{120}_1$, $\mathbf{120}_2$ are discussed herein as being central processing units (CPUs) and, in particular, as server CPUs. However, it is to be appreciated that the techniques and configurations described herein may be applied to many different types of devices for which a high speed communications link would be suitable. In some embodiments, the processing unit may include many different functions, such as with a SoC (System on a Chip). In other embodiments, the processing units may be memory, a communications interface hub, a storage device, co-processor or any other desired type of chip. In an additional embodiment, the two processing units may be different. For example, the first processing unit $\mathbf{120}_1$ may be a CPU and the second processing unit $\mathbf{120}_2$ may be a memory or a chipset. Though omitted from the Figures in order to not unnecessarily obscure particular embodiments of the invention, additional embodiments may include one or more heat spreaders that contact and/or cover the components formed on the PCB 105. For example, the one or more heat spreaders may cover a portion of the PCB 105 or the entire PCB 105.

Each processing unit 120 may be communicatively coupled through the package to one or more radio frequency integrated circuits (RFICs) 130A-130D. For example, the processing units 120 in the illustrated embodiment are communicatively coupled to the RFICs 130 by conductive traces 135. In an embodiment, each of the RFICs 130 may be formed of a single die or a package with multiple dies or using another technique. According to an embodiment, the RFICs 130 may include dedicated transmit (TX) chains and receive (RX) chains for processing transmitted or received wireless communications 195. The TX chain may up-convert baseband signals from the processing unit 120 into a format that may be transmitted by the antenna 140, and the RX chain may down-convert signals received by the antenna 140 into baseband signals that may be sent to the processing unit 110. The RFICs 130 may also contain circuitry for processing the signals to filter noise or cross-talk. For example, embodiments may include a feed network for inserting phase shifted signals that produce constructive and/or destructive interference at the receiving antennas, as will be described in greater detail below.

According to an embodiment, each of the RFICs 130A-130D may be coupled to a corresponding antenna 140A-140D. While four RFIC/antenna pairs are illustrated on each package substrate 110 in FIG. 1A, it is to be appreciated that each processing unit 120 may be coupled to one or more RFIC/antenna pairs, according to an embodiment. For example, embodiments of the invention may include a processing unit 120 that is communicatively coupled with approximately thirty or more RFIC/antenna pairs formed on the package substrate. Additional embodiments also include forming RFIC/antenna pairs along multiple edges of the package substrate 110. Other embodiments include coupling a plurality of antennas 140 to each RFIC 130.

Embodiments of the invention include antennas 140 that may be integrated onto or into the package substrate 110. The antennas 140 may be positioned so that when the first package substrate $\mathbf{110}_1$ and the second package substrate $\mathbf{110}_2$ are mounted to the motherboard 105, the corresponding antennas are directed to each other. For example, antenna 140B on the first package substrate $\mathbf{110}_1$ is directed at antenna 140B on the second package substrate $\mathbf{110}_2$. Additional embodiments may utilize beam steering techniques to allow antennas that are not lined up to send and receive information. For example, antenna 140C on the first package substrate $\mathbf{110}_1$ may be able to send or receive wireless communications from antenna 140D on the second package substrate $\mathbf{110}_2$. The short distance between the antennas allow for a low power and low noise connection between the two chips. The antennas 140 illustrated in FIG. 1A are represented as a single component, however, it is to be appreciated that in some embodiments each antenna 140 may comprise a receive antenna and a transmit antenna.

While different frequencies may be used to suit particular implementations, embodiments of the invention may include millimeter wave and sub-THz frequencies. In one embodiment, the wireless communications may be in the 100-140 GHz band. The use of millimeter wave frequencies and the close proximity of the transmitting and receiving antennas 140, allow for an antenna that is small enough to be integrated on the same package that is normally used for the chip. Furthermore, the antennas may also be constructed using the same materials and processes that are used in the fabrication of the package substrates 110 (e.g., the materials and processing used to form alternating layers of conductive material for interconnect lines and dielectric layers, and vias formed through the dielectric layers) and still exhibit good electrical performance.

Figure 1B:
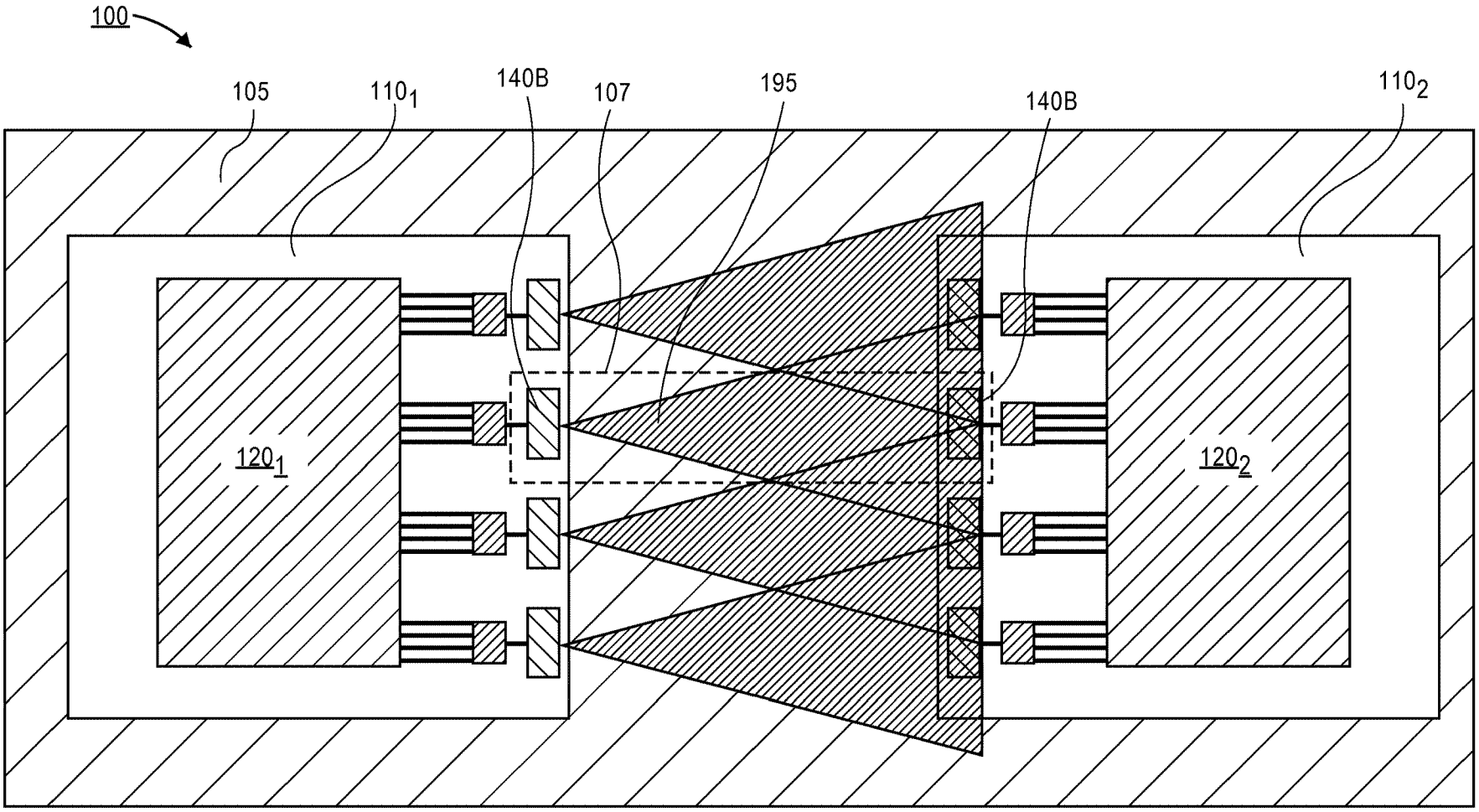
FIG. 1B is a plan view illustration of a server package that includes wireless interconnects that send wireless communications that may cause cross-talk with neighboring wireless interconnects, according to an embodiment of the invention.

Antennas according to such embodiments allow for a small footprint because they may be positioned in close proximity with each other. However, the close proximity between neighboring antennas may result in cross-talk between antennas 140. FIG. 1B is a plan view illustration that depicts the problem of cross-talk and interference. According to an embodiment, a plurality of antennas 140 may be positioned on each package so that they are paired with a corresponding antenna on the opposite package. For purposes of simplicity, and to not obscure particular embodiments of the invention, the antennas 140 on the first package $\mathbf{110}_1$ are considered to be the transmitting antenna, and the antennas 140 on the second package $\mathbf{110}_2$ are considered to be the receiving antenna. However, it is to be appreciated that each wireless interconnect (e.g., an antenna pair such as the antennas 140B inside box 107) may include a transmit antenna and a receive antenna on each package, thereby allowing data to be transmitted in either direction.

Embodiments of the invention may include antenna pairs that operate over the full operating band in order to achieve the highest possible data transfer rate. However, since each antenna pair is operating over potentially the same band, data 195 that is being transferred between one antenna pair may propagate in a wide beam that may be picked up by neighboring receiving antennas. The unwanted data that is obtained from neighboring antennas that are not part of the channel results in interference or cross-talk being received. In the illustrated embodiment, each of the antennas 140 transmit data 195 in a wide beam that is received by the at least the nearest neighboring receiving antenna 140. It is to be appreciated that depending on various factors (e.g., the power, the distance between the antennas, the radiation pattern of the antennas, etc.) each antenna may receive cross-talk or interference from a plurality of different antennas 140.

Several solutions are available for reducing the cross-talk. For example, the separation between each wireless interconnect may be increased. Increasing the separation allows for the cross-talk from neighboring interconnect channels to not be detected by the receiving antenna. However, increasing the spacing between each wireless interconnect forces more real estate on the package to be used, or reduces the number of wireless interconnects that can be used. Alternatively, multiple frequency bands may be used. For example, a 40 GHz band may be split into four channels that have a bandwidth of 10 GHz each. The wireless interconnects are then able to be placed close together because the cross-talk from each band can be filtered out. However, splitting the bandwidth into smaller channels reduces the data transfer rate as well. In the example above, splitting the bandwidth into four channels decreases that data transfer rate by a factor of four. Accordingly, embodiments of the invention may utilize various structures and processes in order to reduce the cross-talk and interference seen by each receiving antenna 140 without needing to increase the separation between each wireless interconnect and without splitting the overall bandwidth.

Figure 2A:
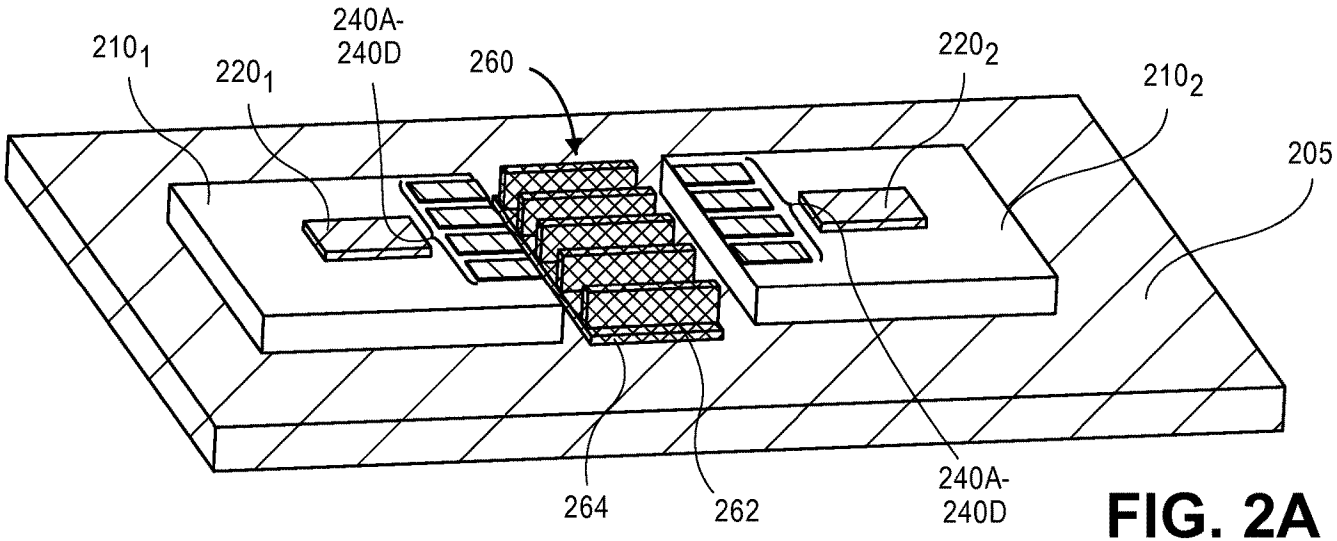
FIG. 2A is a perspective view illustration of a server package that includes wireless interconnects and a guiding structure formed between the first chip package and the second chip package, according to an embodiment of the invention.

Referring now to FIG. 2A, a perspective view of a wireless chip system that includes a physical guiding structure 260 is shown, according to an embodiment of the invention. The guiding structure 260 is an anisotropic wave guiding medium. Accordingly, embodiments of the invention include a structure that is able to prevent the transmitted wave from passing through the structural elements of the guiding structure. In the illustrated embodiment, the guiding structure 260 includes a plurality of fins 262 that extend up from a baseplate 264. For example, the fins 262 may extend a height in the Z-direction that is greater than the height of the antennas 240. As such, the height of the fins 262 may be dependent on various design factors (e.g., the thickness baseplate 264, the stand-off height of the antennas 240, whether the guiding structure 260 is mounted directly to the motherboard 205, or whether the guiding structure 260 is mounted over additional components, etc.) The fins 262 are oriented along the transmission path of the waves and allow the waves to propagate only along the desired direction, while preventing the waves from propagating in a direction that will cause cross-talk to be picked up by other antennas.

Figure 2B:
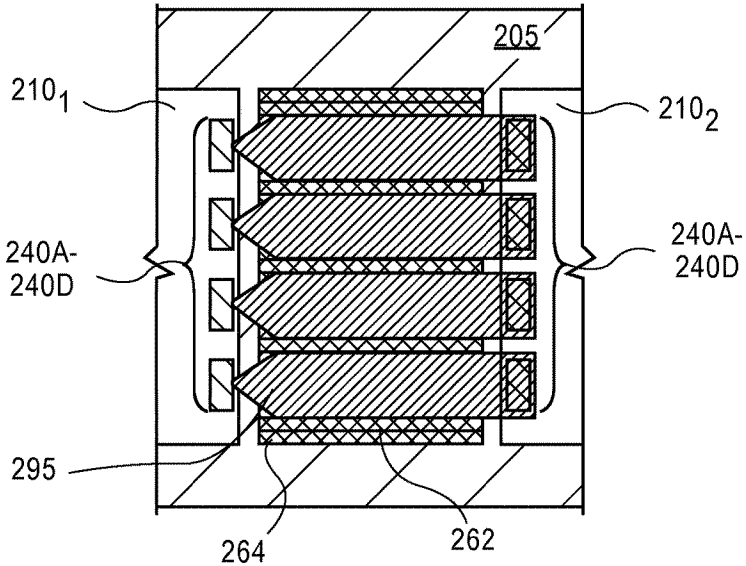
FIG. 2B is a partial plan view illustration of the server package in FIG. 2A, according to an embodiment of the invention.

In order to prevent the waves 295 from propagating outside of the desired path, the guiding structure is made from a material that is not penetrable by the waves 295. The confinement of the wireless signals 295 is illustrated in the plan view in FIG. 2B. In FIG. 2B, the antennas 240A-240D on the first package substrate $\mathbf{210}_1$ are illustrated as being the transmitting antennas, and the antennas 240A-240D on the second package substrate $\mathbf{210}_2$ are illustrated as being the receiving antenna. However, it is to be appreciated that the wireless signals 295 may be transmitted in either direction, according to various embodiments.

Once the wireless signal 295 enters the guiding structure 260, the wireless signal 295 becomes confined and follows the path defined by the fins 262. In an embodiment, communications in the mm-wave range will not penetrate a metallic material more than a few multiples of the skin depth of the wave. Accordingly, embodiments of the invention may utilize a metallic guiding structure 260. For example, the guiding structure 260 may be a copper material. Additional embodiments may include a guiding structure 260 that includes a plastic core that is plated with a metallic material. Embodiments include pathways through the guiding structure 260 that are defined by a plurality of fins 262. For example, each pathway from a transmitting antenna to a receiving antenna may be defined by two fins 262. Additional embodiments are not limited to such configurations, and the pathways through the guiding structure 260 may be defined by more than two fins 262, as will be described in greater detail below.

In addition to preventing cross-talk between wireless interconnects, the use of a guiding structure 260 reduces the attenuation of the wireless signal 295. Since the wireless signal 295 is confined along the pathway between the fins 262, the signal does not spread outwards in unwanted directions and the power of the signal is focused along the pathway through the guiding structure 260. As such, embodiments of the invention may be able to transmit the wireless signals 295 at a lower power or over longer distances than would otherwise be possible when a guiding structure 260 is not used.

According to an embodiment, the guiding structure 260 may have additional functionality beyond being wave guide. For example, the guiding structure 260 may also be a heat sink. This additional feature may be particularly beneficial when the plurality of fins 262 that form the pathways through the guiding structure 260 have similar dimensions and shapes to the fins typically used for heat sinks. The use of a guiding structure 260 as a heat sink can aid in the thermal management of the device. Additionally, the space between the packages may be used for other components that need cooling. In an embodiment of the invention, one or more additional components (not shown) may be mounted to the motherboard 205 between the first package substrate $\mathbf{210}_1$ and the second package substrate $\mathbf{210}_2$, and the baseplate 264 may be placed over the additional components. Additionally, the baseplate 264 of the guiding structure may be formed over the motherboard 205. For example, many server packages include heat sinks close to the CPU on top of the motherboard power delivery circuits. Accordingly, the heat sink used for these applications may also be used for the guiding structure 260. In such embodiments, using the heat sink as the guiding structure 260 allows for the cross-talk between the wireless interconnects to be reduced without the need to add additional components or complexity to the server package.

The use of an existing heat sink for the guiding structure may not even require a significant redesign of the heat sink. There may not need to be a significant redesign, because embodiments of the invention may include a guiding structure that includes fins that are formed at a pitch that is different than the pitch of the antennas. In an embodiment, the pitch of the fins on the guiding structure may be equal to or less than the pitch of the antennas. The partial plan view illustrated in FIG. 3A provides an example of a server package that includes a guiding structure 360 that includes fins 360 that have a different pitch than the pitch of the antennas 340. For example, the pitch $P_F$ of the fins 362 may be smaller than the pitch $P_A$ of the antennas 340. In one embodiment, the pitch $P_F$ of the fins 362 may be approximately one-half the pitch $P_A$ of the antennas 340. As illustrated, the wirelessly transmitted data 395 from each antenna 340 may be partially propagated through two or more pathways through the guiding structure 360. So long as each individual pathway defined by the fins 262 receives transmitted data 395 from a single antenna 340, the use of multiple pathways for each wireless interconnect prevents cross-talk from wireless data transmitted from a neighboring antenna.

The minimum pitch of the fins 362 may be dependent on the polarity of the wave being propagated through the guiding structure 260. For example, when the polarity of the wave is parallel with the pathways defined by the fins 362, then the minimum pitch may be smaller than when the polarity of the wave is perpendicular to the passages through the fins 362. Some embodiments of the invention may include a wave with polarity that is both parallel and perpendicular to the pathways through the fins 262. In such embodiments, the minimum pitch of the fins may be limited by the perpendicular polarity. For example, the minimum pitch may be close to approximately one-half the wavelength of the propagated signal.

The use of fins 362 that are formed at a pitch that is smaller than the pitch of the antennas 340 may increase the heat dissipation that is provided by the guiding structure because there is an increased surface area that may be used to remove heat from the device. Additionally, using fins 362 that have a smaller pitch than the pitch of the antennas 340 allows for pre-existing heat sinks to be used as the guiding structure. For example, a pre-existing heat sink may have cooling fins with a pitch that is not equal to the pitch of the antennas 340. In such instances, the heat sink would not need to be redesigned in order to have an equal pitch to the antennas 340 (so long as the pitch of the cooling fins is less than the pitch of the antennas 340). Accordingly, a heat sink that may already be needed for thermal management may be used without needing to be redesigned to account for wireless transmission considerations.

According to additional embodiments of the invention, guiding structures may direct the propagation of the wireless signal 395 from a transmitting antenna to a receiving antenna that is not positioned directly across from the transmitting antenna. For example, the use of such a guiding structure 360 may allow for increased flexibility in the positioning of antennas that are used to form a wireless interconnects. Guiding structures according to such embodiments are illustrated in FIGS. 3B-3E.

Figure 3B:
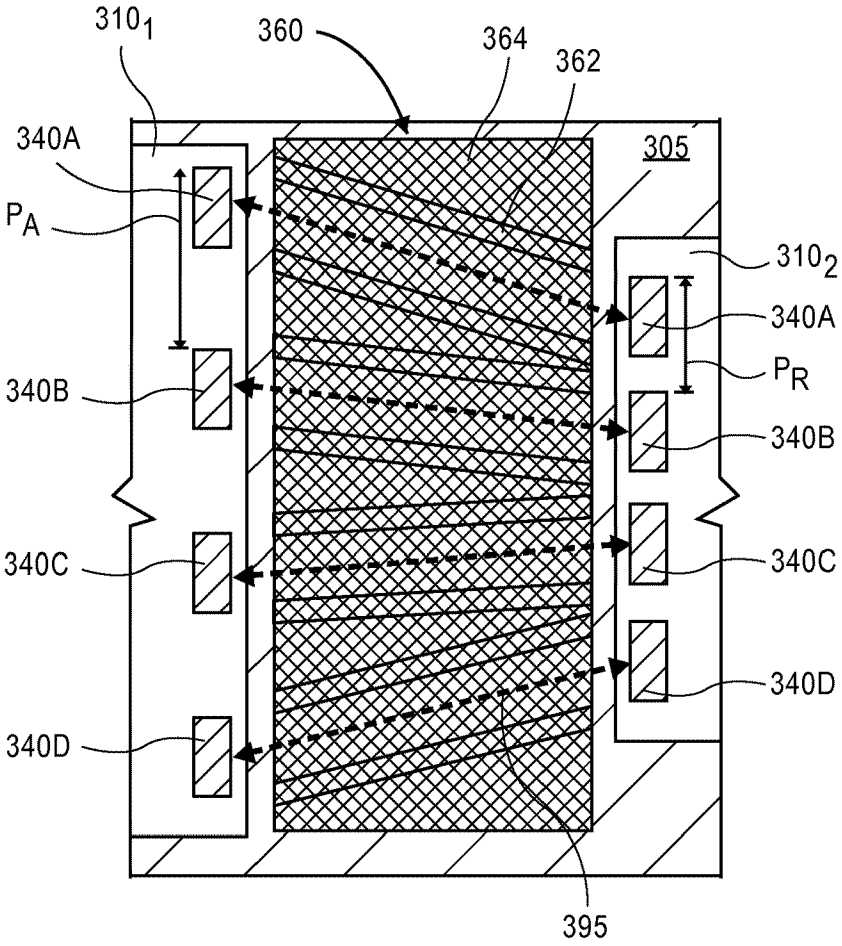
FIG. 3B is a partial plan view illustration of a server package that includes a guiding structure that includes fins that form pathways that direct signals between antennas when the antennas are not aligned with each other, according to an embodiment of the invention.
Figure 3A:
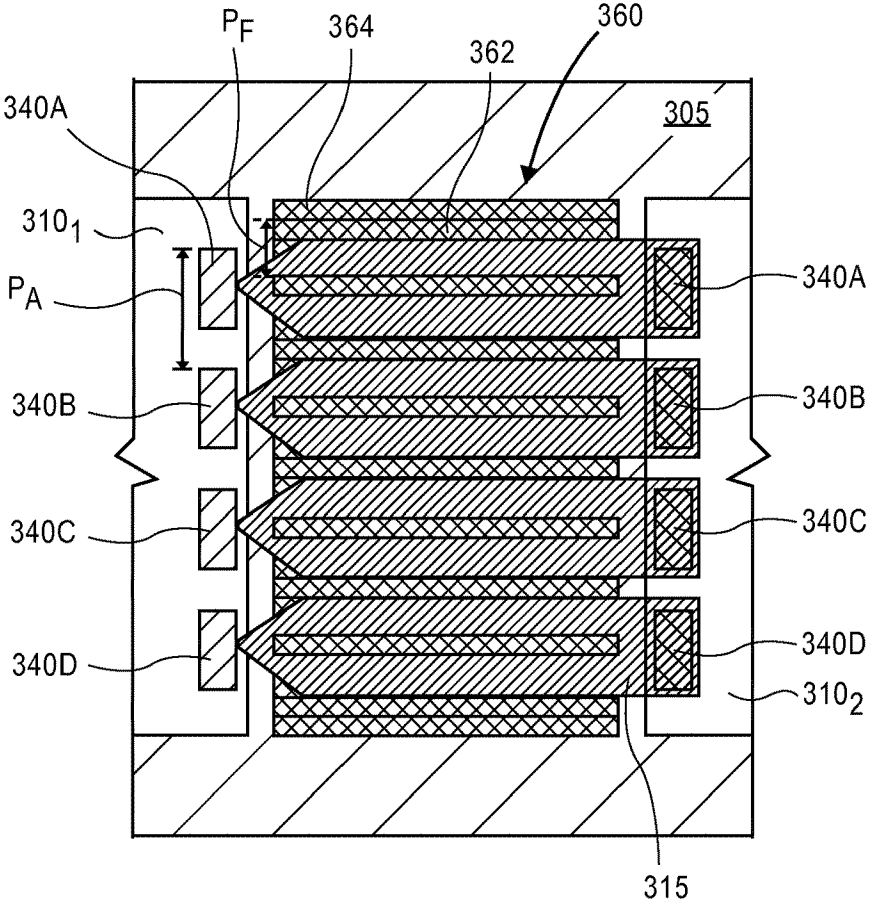
FIG. 3A is a partial plan view illustration of a server package that includes a guiding structure that has fins that are formed with a pitch that is different than the pitch of the antennas, according to an embodiment of the invention.

Referring now to FIG. 3B, a guiding structure 360 is used that allows for antennas 340 on a first package substrate $\mathbf{310}_1$ to be positioned at a first pitch $P_A$ and antennas 340 on a second package substrate $\mathbf{310}_2$ to be positioned at a second pitch $P_R$ that is smaller than the first pitch $P_A$. In order to form wireless interconnects between corresponding antennas (e.g., antenna 340A on the first package substrate $\mathbf{310}_1$ and antenna 340A on the second package substrate $\mathbf{310}_2$), the wireless signals 395 need to be guided between the devices in order to account for their misalignment.

In order to provide the proper path to the targeted antenna, some embodiments of the invention may include a guiding structure 360 that includes pathways that are not all parallel to each other. In such an embodiment, each pathway through the guiding structure may be defined by two or more fins 362 that are substantially parallel to each other. The fins 362 that run parallel to each other may confine a wireless signal 395 that enters the pathway until it exits the guiding structure 360 at the opposite end proximate to the receiving antenna 340. Since each pathway does not need to run parallel to each other, embodiments of the invention are able to provide a guiding structure 360 that provides a plurality of non-parallel pathways that accommodate the change in pitch between the antennas 340 on the first package substrate $\mathbf{310}_1$ and the antennas 340 on the second package substrate $\mathbf{310}_2$. Such embodiments may be beneficial when the processing units on different package substrates are different and require packaging substrates of different size.

Figure 3C:
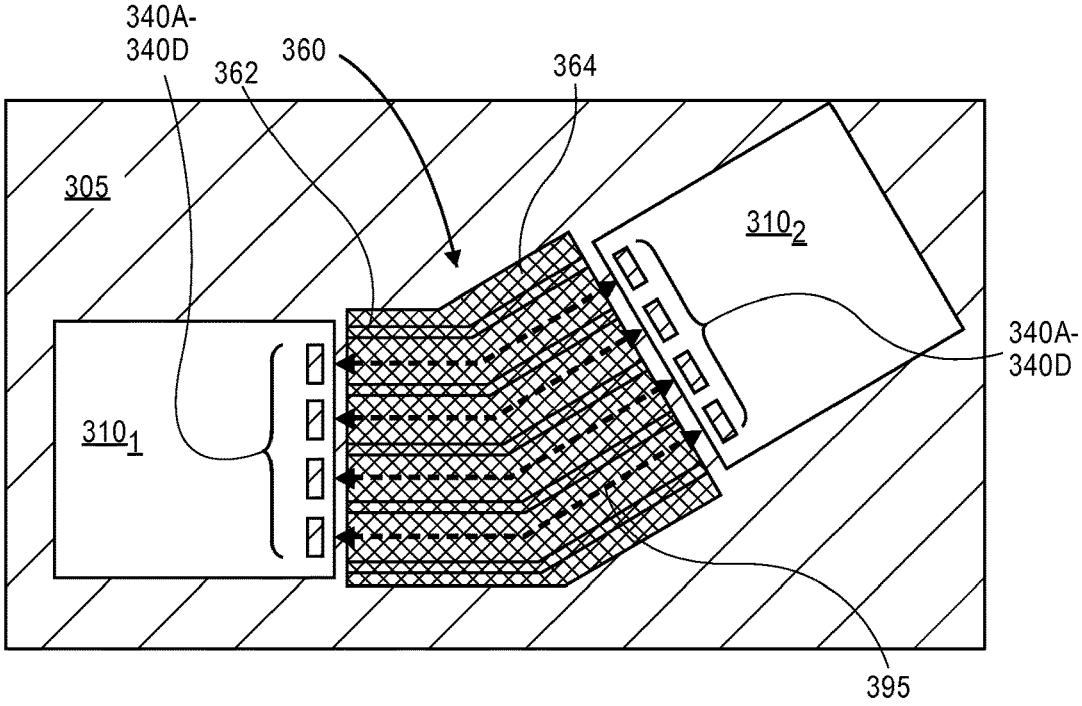
FIG. 3C is a partial plan view illustration of a server package that includes a guiding structure with fins that define pathways between the antennas on packages that are not aligned with each other, according to an embodiment of the invention.

The use of a guiding structure 360 also provides flexibility in the placement of the packaging substrates on the motherboard 305. FIG. 3C provides a partial plan view of a server package where the first and second package substrates are placed on the motherboard 305 such that the antennas 340 are not oriented in the same direction. As illustrated in FIG. 3C, the first package substrate $\mathbf{310}_1$ includes antennas 340A-340D that are oriented in the X-direction, and the antennas 340A-340D on the second package substrate $\mathbf{310}_2$ are oriented at an angle with respect to the X-direction. In such embodiments, the guiding structure 360 may include one or more bends that redirect the wireless signals 395 so that they can be received by the opposing antenna in the wireless interconnect.

According to an embodiment, the guiding structure 360 may improve the signal quality by including fins 362 that are oriented parallel to the desired propagation path of the signal 395 proximate to the antennas 340. If the opening to the pathway defined by the fins 362 is not parallel with the desire propagation path of the signal 395, portions of the signal may not enter the desired pathway. Additionally, the portion of the signal 395 that does not enter the desired pathway may leak into a neighboring pathway and cause undesirable cross-talk between neighboring wireless interconnects. Angled entries to the pathways may also result in reflections of the signal off of fin walls within the pathway the degrade the signal quality.

Additional embodiments of the invention may also include a guiding structure that allows for an antenna to simultaneously transmit a wireless signal 395 to two separate antennas 340. An example of such an embodiment is illustrated in the plan view shown in FIG. 3D. In the illustrated embodiment, the package substrates $\mathbf{310}_1$, $\mathbf{310}_2$, and $\mathbf{310}_3$ have been simplified to depict a single antenna 340. However, it is to be appreciated that each package substrate 310 may include a plurality of antennas 340, according to embodiments of the invention. In the illustrated embodiment, the antenna 340 on the first package substrate $\mathbf{310}_1$ transmits a signal 395 that enters a pathway on the guiding structure 360 that is defined by fins 362. At some point along the pathway, the fins 362 that run parallel to each other may diverge from each other, for example at the split 366. Embodiments then include a third fin 362 that continues the pathway in two different directions towards the antenna 340 on the second package substrate $\mathbf{310}_2$ and towards the antenna 340 on the third package substrate $\mathbf{310}_3$. Embodiments of the invention may include openings to the pathway that are oriented substantially parallel with the propagation path of the wireless signal 395 proximate to the antennas 340 on the first package substrate 310$_1$, the second package substrate 310$_2$, and the third package substrate 310$_3$.

Figure 3D:
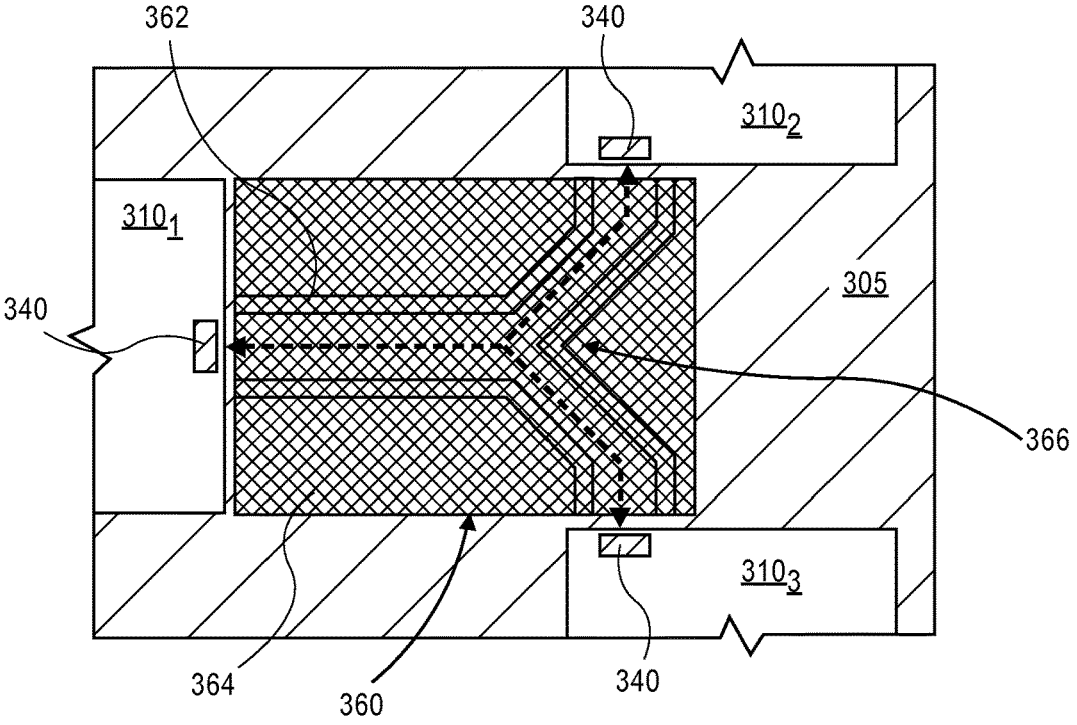
FIG. 3D is a partial plan view illustration of a server package that includes a guiding structure with fins that define a pathway that routs a signal from one antenna on a first package to second and third antennas on second and third packages, respectively, according to an embodiment of the invention.

While a single branch is illustrated in FIG. 3D, it is to be appreciated that one or more branches may be used in order to enable communication with a plurality of different antennas. It is to be appreciated that simply broadcasting a wireless transmission directed to multiple antennas without a guiding structure would result in unwanted cross-talk being received by any other antenna within range. Accordingly, the use of a guiding structure 360, such as the one described in FIG. 3D, allows for a controlled way to direct a wireless signal to two or more specific antennas located on different package substrates.

Figure 3E:
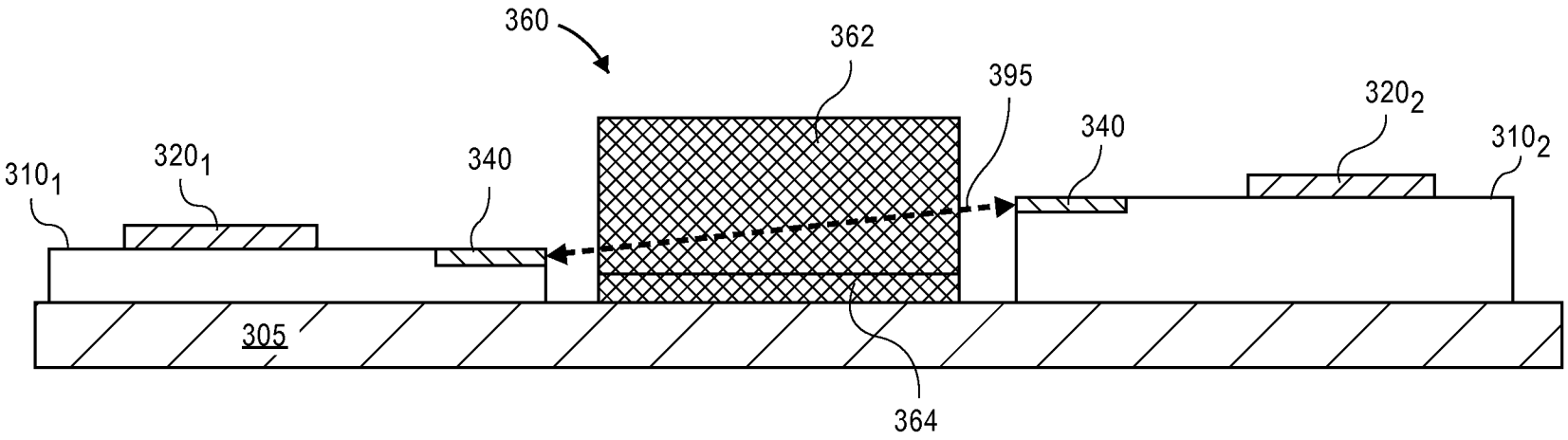
FIG. 3E is a cross-sectional illustration of a server package that includes a guiding structure with fins that define a pathway that routes a signal from an antenna on a first package to an antenna on a second package that is positioned at a different Z-height, according to an embodiment of the invention.

Referring now to FIG. 3E, a cross-sectional view of an embodiment of the invention is illustrated that shows antennas 340 that may be communicatively coupled when they are not aligned in the Z-direction. Allowing for antennas to communicate with each other when they are not aligned in the Z-direction allows for increased flexibility in the design and placement of the packages. For example, in the illustrated embodiment, the first package substrate 310$_1$ has a standoff height that is lower than the standoff height of the second package substrate 310$_2$. In such embodiments, forming the antennas 340 on the top surfaces of the substrate still allows for them to transfer and receive signals without cross-talk from neighboring antennas when a guiding structure 360 is used. In an embodiment, the height of the fins 362 may extend above a top surface of the antenna 340 on the second substrate 310$_2$ in order to ensure that the signal 395 is confined to the pathway through the guiding structure 360 until it reaches the antenna 340 on the second substrate 310$_2$. According to additional embodiments, the difference in Z-height between antennas 340 may be attributable to other factors. For example, while the substrate packages 310 may have the same standoff height, the antennas 340 may be formed in different layers of the package substrate 310.

In addition to using structural elements to guide the propagation path of a wireless transmission, embodiments of the invention may also include cross-talk reduction by adjusting the phases of the signals transmitted by antennas to constructively interfere at the desired receiving antenna and destructively interfere at the other antennas.

Figure 4:
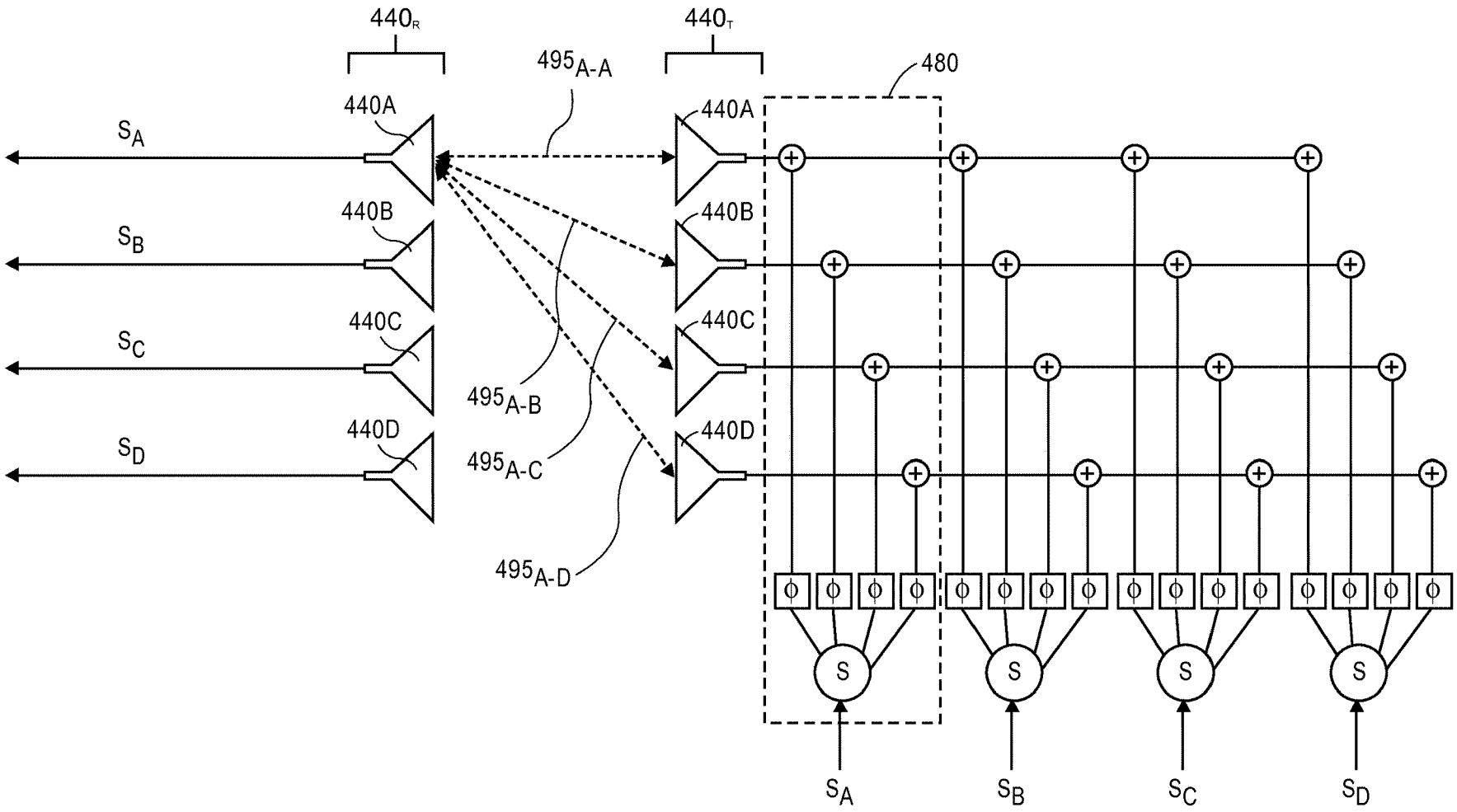
FIG. 4 is a feed diagram of an antenna array that allows for cross-talk reduction by introducing phase shifted signals into each antenna to produce constructive or destructive interference at the receiving antennas, according to an embodiment of the invention.

FIG. 4 is a schematic of a feed network that may be used to provide a reduction in cross-talk between the signals that are transferred across wireless interconnects. In FIG. 4, an array of transmitting antennas 440$_T$ and an array of receiving antennas 440$_R$ are illustrated. According to an embodiment, the transmitting antennas 440$_T$ and the receiving antennas 440$_R$ may be antennas formed on package substrates similar to those described above with respect to FIG. 1A. However, instead of using structural elements to direct and confine the signals, constructive interference may be used.

In FIG. 4, the constructive interference is supplied by sending each signal through each of the transmitting antennas 440A$_T$-D$_T$. For example, antenna 440A$_R$ may receive signals that are transmitted by each of the transmitting antennas (i.e., 440A$_R$ may receive the signals 495$_{A\text{-}A}$, 495$_{A\text{-}B}$, 495$_{A\text{-}C}$, and 495$_{A\text{-}D}$). If each signal received by the receiving antenna 440A$_R$ is the same signal (e.g., $S_A$), the signals received by the receiving antenna 440A$_R$ may be substantially similar, except that the phase may be shifted. Accordingly, the differences between the phases of the signals received by the receiving antenna 440A$_R$ may be phase shifted prior to being transmitted so that when they reach the receiving antenna 440A$_R$, they are all in phase and produce constructive interference. An exemplary schematic for supplying a phase shifted signal $S_A$ to each of the transmitting antennas 440A$_T$-D$_T$ is shown inside of dashed box 480.

In order to produce constructive interference at the desire receiving antenna 440$_R$, embodiments of the invention may insert a phase shifted version of the signal $S_A$ into the feeds for each of the transmitting antennas 440$_T$. In FIG. 4, the phase shifted version of the signal $S_A$ is represented by the boxes labeled $\phi$. The amount that the phase of the signal $S_A$ is shifted for each antenna feed may be dependent on the physical positioning of the receiving antenna 440A$_R$ from the transmitting antennas 440A$_T$-D$_T$. For example, the phase modification of signal $S_A$ may be different with respect to each of the transmitting antennas, because each of the transmitting antennas 440A$_T$-D$_T$ are a different distance from the receiving antenna 440A$_R$. The distance between antennas 440 may be attributable to differences in the position along the X-Y plane, as illustrated in FIG. 4. Additional embodiments may include differences in position that are attributable to the difference in position in the Z-direction, similar to difference in Z-height of the antennas 340 illustrated in FIG. 3E. Accordingly, some embodiments include a phase shifting $\phi$ that accounts for differences in location in the X, Y, and Z-directions. In an embodiment, the phase shifting $\phi$ of each signal $S_A$ supplied to the transmitting antennas 440A$_T$-D$_T$ should be offset so that when the signals are received by the receiving antenna 440A$_R$, the signals from each antenna are synchronized, therefore producing constructive interference in order to amplify the received signal $S_A$.

As illustrated in the exemplary feed network in FIG. 4, each of the other signals $S_B$-$S_D$ are also phase modified and transmitted through each of the transmitting antennas 440A$_T$-D$_T$ in a substantially similar manner. Accordingly, each receiving antenna 440A$_R$-D$_R$ may receive the targeted signal with constructive interference providing an amplification of only the desired signal over the unwanted cross-talk. The addition of other signals (e.g., $S_B$-$S_D$) is possible without further complicating the system because the system is a linear system.

According to an additional embodiment of the invention, the signal modification may also include an amplitude modification. For example, as the signal travels further, the signals will have increased attenuation. Accordingly, embodiments of the invention may include signal modification that also increases amplitude of the signal that is transmitted a further distance. For example, the signal 495$_{A\text{-}D}$ transmitted from transmitter 440D$_T$ to receiver 440A$_R$ may have an amplitude modification that is greater than the amplitude modification of signal 495$_{A\text{-}B}$ transmitted from transmitter 440B$_T$ to receiver 440A$_R$. Amplitude modification may be more beneficial when the distance between the transmitting antennas and the receiving antennas is relatively large. At short distances, such as less than approximately 5 centimeters, the attenuation between the signals may not be significant. Accordingly, some embodiments may include phase modification only, without the need for amplitude modification.

In an additional embodiment, a similar feed network may be used to insert phase shifted versions of the signals into each of the transmitting antennas in order to produce destructive interference at neighboring receiving antennas as well. For example, if it is know that receiving antenna 440A$_R$ will receive cross-talk from a signal $S_D$ transmitted from antenna 440D$_T$ to antenna 440D$_R$, then a phase shifted version of signal $S_D$ that will result in destructive interference of the anticipated cross-talk may be inserted into the feed for antenna 440$A_T$. Accordingly, the receiving antenna 440$A_R$ will simultaneously receive the unwanted cross-talk from antenna 440$D_T$ and the destructive interference signal from antenna 440$A_T$ that will cancel the cross-talk. It is to be appreciated that the use of constructive interference and destructive interference may be used at the same time, according to embodiments of the invention.

Embodiments of the invention include several different processes for determining the amount the phase and amplitude need to be modified for each signal. For example, the feed network may be an active or passive network. In one embodiment where a passive feed network is used, the phase and amplitude (if needed) modifications may be determined before signals are sent between the antenna arrays. The geometry of the arrays may be used to determine the spacing between individual antennas. The desired phase modification to produce constructive and/or destructive interference may then be calculated from the spacings prior to sending signals between the antennas. Additionally, if the configuration of the antennas are changed (e.g., an array of antennas are replaced, or moved to a different location) then a new calculation of the phase modifications needed may be performed.

Additional embodiments include shifting the phases with an active network. According to such an embodiment, the required phase modification may be determined periodically by the system. For example, the beginning of each transmission may include a test packet that is sent over each of the transmitting antennas. The amount of phase offset may then be recorded at each receiving antenna. The updated values may then be used during the subsequent transmission. Additionally, bit error rate testing may be used periodically to determine if the phase modifications of the signals need to be recalculated. For example, if the bit error rate is above a specified threshold, then the new phase modification may need to be calculated.

In FIG. 4, the feed network is illustrated as being only on one side of the communication channels, however embodiments are not limited to such configurations. For example, a second feed network may be on the side of the receiving antennas 440$_R$ as well. Additionally, since the system is linear, the processing may be implemented on either the receiving or transmitting side of the device. Embodiments that include amplitude modification and phase shifting may implement the phase shifting on one side of the device and the amplitude modification on the other side of the device, or both the phase shifting and the amplitude modification may be performed on a single side of the device.

Figure 5:
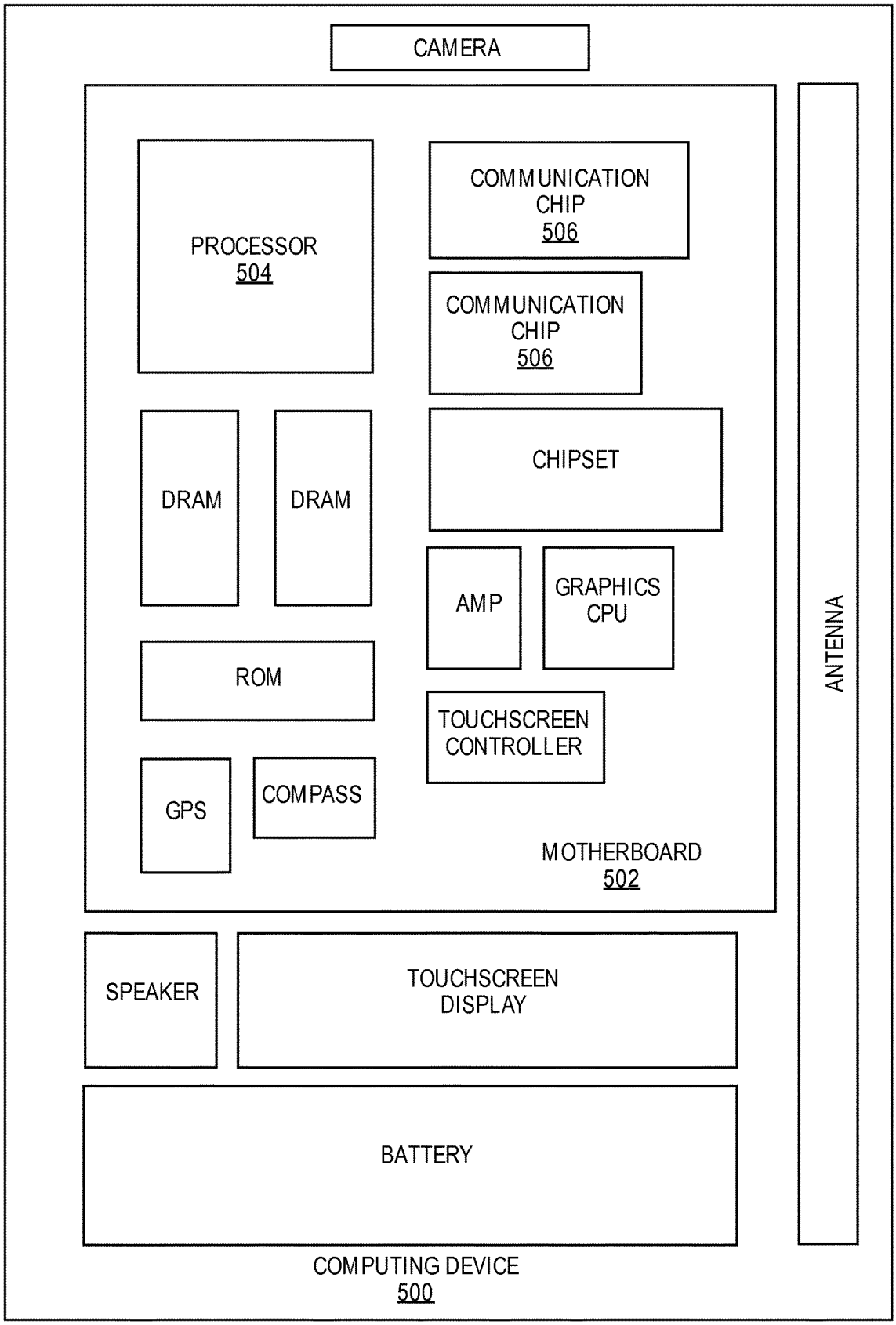
FIG. 5 is a schematic of a computing device built in accordance with an embodiment of the invention.

FIG. 5 illustrates a computing device 500 in accordance with one implementation of the invention. The computing device 500 houses a board 502. The board 502 may include a number of components, including but not limited to a processor 504 and at least one communication chip 506. The processor 504 is physically and electrically coupled to the board 502. In some implementations the at least one communication chip 506 is also physically and electrically coupled to the board 502. In further implementations, the communication chip 506 is part of the processor 504.

Depending on its applications, computing device 500 may include other components that may or may not be physically and electrically coupled to the board 502. These other components include, but are not limited to, volatile memory (e.g., DRAM), non-volatile memory (e.g., ROM), flash memory, a graphics processor, a digital signal processor, a crypto processor, a chipset, an antenna, a display, a touchscreen display, a touchscreen controller, a battery, an audio codec, a video codec, a power amplifier, a global positioning system (GPS) device, a compass, an accelerometer, a gyroscope, a speaker, a camera, and a mass storage device (such as hard disk drive, compact disk (CD), digital versatile disk (DVD), and so forth).

The communication chip 506 enables wireless communications for the transfer of data to and from the computing device 500. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 506 may implement any of a number of wireless standards or protocols, including but not limited to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPRS, CDMA, TDMA, DECT, Bluetooth, derivatives thereof, as well as any other wireless protocols that are designated as 3G, 4G, 5G, and beyond. The computing device 500 may include a plurality of communication chips 506. For instance, a first communication chip 506 may be dedicated to shorter range wireless communications such as Wi-Fi and Bluetooth and a second communication chip 506 may be dedicated to longer range wireless communications such as GPS, EDGE, GPRS, CDMA, WiMAX, LTE, Ev-DO, and others.

The processor 504 of the computing device 500 includes an integrated circuit die packaged within the processor 504. In some implementations of the invention, the integrated circuit die may be packaged with one or more devices on a package substrate that includes a guiding structure for use with wireless communications, in accordance with implementations of the invention. The term "processor" may refer to any device or portion of a device that processes electronic data from registers and/or memory to transform that electronic data into other electronic data that may be stored in registers and/or memory.

The communication chip 506 also includes an integrated circuit die packaged within the communication chip 506. In accordance with another implementation of the invention, the integrated circuit die of the communication chip may be packaged with one or more devices on a package substrate that includes a guiding structure for use with wireless communications, in accordance with implementations of the invention.

The above description of illustrated implementations of the invention, including what is described in the Abstract, is not intended to be exhaustive or to limit the invention to the precise forms disclosed. While specific implementations of, and examples for, the invention are described herein for illustrative purposes, various equivalent modifications are possible within the scope of the invention, as those skilled in the relevant art will recognize.

These modifications may be made to the invention in light of the above detailed description. The terms used in the following claims should not be construed to limit the invention to the specific implementations disclosed in the specification and the claims. Rather, the scope of the invention is to be determined entirely by the following claims, which are to be construed in accordance with established doctrines of claim interpretation. The following examples pertain to further embodiments. The various features of the different embodiments may be variously combined with some features included and others excluded to suit a variety of different applications.

Some embodiments pertain to a packaged device, comprising: a first package substrate mounted to a printed circuit board (PCB); a plurality of first antennas formed on the first package; a second package substrate mounted to the PCB; a second plurality of antennas formed on the second package; and a guiding structure formed between the first and second packages, wherein the guiding structure comprises a plurality of fins that define a plurality of pathways between the first antennas and the second antennas.

Additional embodiments of the invention include a packaged device, wherein the guiding structure is a heat sink.

Additional embodiments of the invention include a packaged device, wherein the guiding structure is positioned over a power delivery circuit on the PCB.

Additional embodiments of the invention include a packaged device, wherein the guiding structure is positioned over one or more components that are mounted to the PCB between the first package and the second package.

Additional embodiments of the invention include a packaged device, wherein the pitch of the first antennas is equal to the pitch of the second antennas, and wherein each of the first antennas is positioned in line with different ones of the plurality of pathways.

Additional embodiments of the invention include a packaged device, wherein the plurality of fins have a pitch that is substantially equal to the first pitch.

Additional embodiments of the invention include a packaged device, wherein the plurality of fins have a pitch that is less than the first pitch.

Additional embodiments of the invention include a packaged device, wherein the plurality of pathways are each defined by two fins that are substantially parallel to each other.

Additional embodiments of the invention include a packaged device, wherein the plurality of pathways are each defined by three or more fins.

Additional embodiments of the invention include a packaged device, wherein the pitch of the first antennas is not equal to the pitch of the second antennas, and wherein the plurality of pathways through the guiding structure each provide a path between a first antenna and a second antenna.

Additional embodiments of the invention include a packaged device, wherein at least one of the pathways includes a bend.

Additional embodiments of the invention include a packaged device, wherein at least one of the pathways includes a split that branches the pathway in at least two different directions.

Additional embodiments of the invention include a packaged device, wherein a first of the two directions is towards the second package substrate and a second of the two directions is towards a third package substrate.

Additional embodiments of the invention include a packaged device, wherein the fins of the guiding structure are formed from a material that cannot be penetrated by an electromagnetic wave in the mm-wave frequencies.

Additional embodiments of the invention include a packaged device, wherein the fins are copper.

Additional embodiments of the invention include a packaged device, wherein the fins comprise a plastic core coated with a metallic material.

Additional embodiments of the invention include a packaged device, wherein the first plurality of antennas are located at a lower Z-height than the second plurality of antennas.

Additional embodiments of the invention include a packaged device, wherein the fins of the guiding structure are formed to a height at least above the second plurality of antennas.

Some additional embodiments of the invention may also include a packaged device comprising: a first processing unit; a package substrate to carry the first processing unit; a radio frequency integrated circuit (RFIC) coupled to the first processing unit to receive and process data from the processing unit; and an array of antennas on the package substrate coupled to the RFIC, wherein the RFIC includes a signal feed network that can provide a first signal to a first antenna in the array of antennas and can provide phase shifted first signals to additional antennas in the array of antennas.

Additional embodiments of the invention include a packaged device, wherein the signal feed network can also provide a phase shifted first signal with a modified amplitude.

Additional embodiments of the invention include a packaged device, wherein each of the phase shifted first signals are shifted by a different amount.

Additional embodiments of the invention include a packaged device, wherein the amount the phase shifted first signal is modified is determined by the distance between the first antenna and the other antennas.

Additional embodiments of the invention include a packaged device, wherein the additional antennas transmit the phase shifted first signals at the same time the first antenna transmits the first signal, and wherein each of the transmitted phase shifted first signals and the transmitted first signal constructively interfere at a first location.

Additional embodiments of the invention include a packaged device, wherein the first location is an antenna located on a second package substrate.

Additional embodiments of the invention include a packaged device, wherein the additional antennas transmit the phase shifted first signals at the same time the first antenna transmits the first signal, and wherein each of the transmitted phase shifted first signals and the transmitted first signal destructively interfere at a first location.

Additional embodiments of the invention include a packaged device, wherein the first location is an antenna located on a second package substrate.

Additional embodiments of the invention include a packaged device, wherein the first location is at a different Z-height than the array of antennas.

Some additional embodiments may also include a packaged device, comprising: a first package substrate mounted to a printed circuit board (PCB); a first array of antennas formed on the first package and coupled to a first radio frequency integrated circuit (RFIC), wherein the first RFIC includes a first signal feed network that can provide a first signal to a first antenna in the first array of antennas and can provide phase shifted first signals to additional antennas in the first array of antennas; a second package substrate mounted to the PCB; and a second array of antennas formed on the second package and coupled to a second RFIC, wherein the second RFIC includes a second signal feed network that can provide a second signal to a first antenna in the second array of antennas and can provide phase shifted second signals to additional antennas in the second array of antennas.

Additional embodiments of the invention include a packaged device, wherein the first signal feed network can also provide a phase shifted first signal with a modified amplitude and the second signal feed network can also provide a phase shifted second signal with a modified amplitude.

Additional embodiments of the invention include a packaged device, wherein each of the phase shifted first signals are shifted by a different amount, and wherein each of the phase shifted second signals are shifted by a different amount.

What is claimed is:

1. A packaged device, comprising:

a first package substrate mounted to a printed circuit board (PCB);

a plurality of first antennas formed on the first package;

a second package substrate mounted to the PCB;

a second plurality of antennas formed on the second package; and a guiding structure formed between the first and second packages, wherein the guiding structure comprises a plurality of fins that define a plurality of pathways between the first antennas and the second antennas.

2. The packaged device of claim 1, wherein the guiding structure is a heat sink.

3. The packaged device of claim 2, wherein the guiding structure is positioned over a power delivery circuit on the PCB.

4. The packaged device of claim 2, wherein the guiding structure is positioned over one or more components that are mounted to the PCB between the first package and the second package.

5. The packaged device of claim 1, wherein the pitch of the first antennas is equal to the pitch of the second antennas, and wherein each of the first antennas is positioned in line with different ones of the plurality of pathways.

6. The packaged device of claim 5, wherein the plurality of fins have a pitch that is substantially equal to the first pitch.

7. The packaged device of claim 5, wherein the plurality of fins have a pitch that is less than the first pitch.

8. The packaged device of claim 1, wherein the plurality of pathways are each defined by two fins that are substantially parallel to each other.

9. The packaged device of claim 1, wherein the plurality of pathways are each defined by three or more fins.

10. The packaged device of claim 1, wherein the pitch of the first antennas is not equal to the pitch of the second antennas, and wherein the plurality of pathways through the guiding structure each provide a path between a first antenna and a second antenna.

11. The packaged device of claim 1, wherein at least one of the pathways includes a bend.

12. The packaged device of claim 1, wherein at least one of the pathways includes a split that branches the pathway in at least two different directions.

13. The packaged device of claim 12, wherein a first of the two directions is towards the second package substrate and a second of the two directions is towards a third package substrate.

14. The packaged device of claim 1, wherein the first plurality of antennas are located at a lower Z-height than the second plurality of antennas.

15. A packaged device comprising:

a first processing unit;

a package substrate to carry the first processing unit;

a radio frequency integrated circuit (RFIC) coupled to the first processing unit to receive and process data from the processing unit; and an array of antennas on the package substrate coupled to the RFIC, wherein the RFIC includes a signal feed network that comprises a plurality of signal sources, wherein each signal source is communicatively coupled to more than one of the antennas, and wherein a first signal from a first signal source is able to be transmitted to a first antenna in the array of antennas and a first phase shifted first signal from the first signal source is able to be transmitted to a second antenna in the array of antennas, wherein a phase shift of the first phase shifted signal is dynamic.

16. The packaged device of claim 15, wherein the signal feed network can also provide the first phase shifted first signal with a modified amplitude.

17. The packaged device of claim 15, wherein the second antenna is configured to transmit the first phase shifted first signal at the same time the first antenna is configured to transmits the first signal, and wherein the transmitted first phase shifted first signal and the transmitted first signal are configured to constructively interfere at a first location.

18. The packaged device of claim 17, wherein the first location is an antenna located on a second package substrate.

19. The packaged device of claim 15, wherein the first phase shifted first signal is configured to be transmitted at the same time the first antenna is configured to transmits the first signal, and wherein the transmitted first phase shifted first signal and the transmitted first signal are configured to destructively interfere at a first location.

20. The packaged device of claim 19, wherein the first location is an antenna located on a second package substrate.

21. The packaged device of claim 20, wherein the first location is at a different Z-height than the array of antennas.

22. A packaged device, comprising:

a first package substrate mounted to a printed circuit board (PCB);

a first array of antennas formed on the first package and coupled to a first radio frequency integrated circuit (RFIC), wherein the first RFIC includes a first signal feed network that comprises a first plurality of signal sources, wherein each signal source in the first plurality of signal sources is communicatively coupled to more than one of the antennas in the first array of antennas, and wherein a first signal from a first signal source is configured to be transmitted to a first antenna in the first array of antennas and a first phase shifted first signal from the first signal source is configured to be transmitted to a second antenna in the first array of antennas, wherein a first phase shift of the first phase shifted signal is dynamic;

a second package substrate mounted to the PCB; and a second array of antennas formed on the second package and coupled to a second RFIC, wherein the second RFIC includes a second signal feed network that comprises a second plurality of signal sources, wherein each signal source in the second plurality of signal sources is communicatively coupled to more than one of the antennas in the second array of antennas, and wherein a second signal from a second signal source is configured to be transmitted to a third antenna in the second array of antennas and a second phase shifted second signal from the second signal source is configured to be transmitted to a fourth antenna in the second array of antennas, wherein a second phase shift of the second phase shifted signal is dynamic.

23. The packaged device of claim 22, wherein the first signal feed network can also provide the first phase shifted first signal with a modified amplitude and the second signal feed network can also provide the second phase shifted second signal with a modified amplitude.

* * * * *